US005827475A

United States Patent [19]

Yamashiro et al.

[11] Patent Number: 5,827,475

[45] Date of Patent: Oct. 27, 1998

[54] APPARATUS FOR REMOVING AN ACCRETION FROM AN UPTAKE AT THE EXIT OF METAL PRODUCING FURNACE

[75] Inventors: Akiyoshi Yamashiro, Tokyo; Kiyoshi Fujiwara, Kagawa-ken, both of Japan

[73] Assignee: Mitsubishi Materials Corporation, Tokyo, Japan

[21] Appl. No.: 880,525

[22] Filed: Jun. 23, 1997

[51] Int. Cl.[6] ..... C21B 9/10

[52] U.S. Cl. ..... 266/135; 266/DIG. 1

[58] Field of Search ..... 266/135, 228, 266/DIG. 1

[56] References Cited

U.S. PATENT DOCUMENTS

| | | | |
|---|---|---|---|
| 1,014,258 | 1/1912 | Ross | 266/135 |
| 1,109,533 | 9/1914 | Keith | 266/135 |
| 4,239,442 | 12/1980 | Maynard | 266/228 |
| 5,542,650 | 8/1996 | Abel et al. | 266/DIG. 1 |

*Primary Examiner*—Scott Kastler

*Attorney, Agent, or Firm*—Oblon, Spivak, McClelland, Maier & Neustadt, P.C.

[57] ABSTRACT

A hydraulic cylinder 41 of a second driver 40 brings both a scraper 20 and a first driver 30 into integrally movable relation so that the scraper 20 is caused to intrude into an uptake 10 of a furnace via an opening 14 defined on a vertical wall of the uptake 10, and an accretion removing pawl 21 is positioned on a horizontal wall surface 12 of the uptake 10. Subsequently, a hydraulic cylinder 31 of the first driver 30 moves the scraper 20 on the horizontal wall surface 12 to scrape off any accretion having occurred thereon. The accretion thus scraped is blown off the horizontal wall surface 12 by pressurized air supplied from a pressurized air-supplying source connected to a flange 27.

4 Claims, 8 Drawing Sheets

APPARATUS FOR REMOVING AN ACCRETION FROM AN UPTAKE AT THE EXIT OF METAL PRODUCING FURNACE

BACKGROUND OF THE INVENTION

1. Field of the Invention

This invention relates to an apparatus for mechanically removing an accretion that has built up on an inner wall surface of an uptake at the exit of furnace for continuous smelting of copper.

2. Description of the Related Art

In order to continuously produce copper, a smelting apparatus has heretofore been used which is shown in FIG. 6 of the accompanying drawings. This apparatus is comprised generally of a smelting furnace 1, a slag cleaning furnace 2 and a copper converting furnace 3. The smelting furnace 1 is used to melt and oxidize copper ore with oxygen-enriched air from a vertical lance 7 extending through the roof of the furnace 1, thereby forming a matte M composed predominantly of a mixture of copper sulfide and iron sulfide and a slag S composed of gangue components of the smelting copper ore, flux, iron oxide and so on. The slag cleaning furnace 2 separates the matte M and the slag S from the smelting furnace 1. In the copper converting furnace 3, the matte M separated from the slag S in the slag cleaning furnace 2 is further oxidized to form blister copper C. Melt transferring launders 4 and 5 are interposed between the three furnaces. Copper is thus produced in continuous manner.

In the smelting furnace 1, an uptake 10, seen in FIG. 7, exhausts an exhaust gas containing sulfur substances generated upon reaction of the smelting copper ore and the like with the oxygen-enriched air supplied in a large amount from the lance 7. After being cooled via a waste heat boiler, the exhaust gas is transported to a plant site where sulfuric acid is produced. However, substances such as copper sulfide, iron sulfide or magnetite contained in the exhaust gas frequently deposit on the inner wall surface of the uptake 10 and gradually grow thereon. The deposited substance, commonly termed an accretion, occurs to a remarkably extent, especially on the horizontally extending wall surface 12 of the uptake 10.

The accretion continues to grow and ultimately clogs the uptake 10. The accretion is conventionally removed manually using an accretion removing tool inserted into the uptake 10 through an opening 14 defined at a portion of the wall surface of the uptake. However, the exhaust gas flowing in the uptake 10 has a high temperature, and this requires great care on the part of the cleaning personnel. On the other hand, shutting down the smelting furnace for accretion removal causes a decline in operating efficiency.

SUMMARY OF THE INVENTION

In view of the foregoing problems, it is an object of the present invention to provide an apparatus for mechanical removal of an accretion that has arisen on an inner wall surface of an uptake in a smelting furnace.

It is another object of the present invention to provide an apparatus for mechanical removal of an accretion that has arisen on an inner wall surface of an uptake in a smelting furnace without shutting down the furnace.

In one important aspect of the present invention, there is provided an apparatus for removal of an accretion from a horizontally extending wall surface of an uptake in a smelting furnace, the apparatus comprising a scraper disposed to be slidably movable on the wall surface to thereby scrape the accretion off the latter; a first driver arranged to cause the scraper to slidably move on the wall surface; and second driver arranged to move the scraper and the first driver between a first position in which the scraper is intruded into the uptake from an opening defined on a side wall of the uptake and a second position in which the scraper is retracted to lie outwardly of the uptake.

According to another aspect of the invention, the scraper has an outer surface in opposed relation to a peripheral marginal portion of the opening and with a small gap left therebetween when the scraper is in the first position.

According to still another aspect of the invention, the scraper is provided with means for blowing pressurized air toward the wall surface.

According to still another aspect of the invention, the scraper includes a detachable pawl member for scraping the accretion off the wall surface.

To implement the apparatus of the present invention, the second driver acts to bring both the scraper and the first driver into integrally forward movable relation, thereby causing the scraper to intrude into the uptake through the opening defined on the side wall thereof, and also acts to bring both the scraper and the first driver into integrally rearwardly movable relation, thereby causing the scraper to lie outside the uptake.

Upon arrival at the wall surface of the uptake, the scraper is moved by an impact action of the first driver and hence scrapes any accretion off the wall surface.

The scraper has an outer surface disposed in opposed relation to a peripheral marginal portion of the opening and with a small gap left therebetween when the scraper is moved slidably on the wall surface. This prevents the exhaust gas flowing in the uptake from leaking outward through the gap between the scraper and the opening periphery.

The scraper is also provided with means for blowing a pressurized gas toward the wall surface of the uptake so that the accretion scraped away by the scraper can be easily blown off and removed from the wall surface.

Additionally, the scraper has a pawl member detachably attached thereto, which enables a worn pawl to be easily replaced.

DETAILED DESCRIPTION OF THE PREFERRED EMBODIMENT

With reference to the drawings, the present invention will now be described in greater detail. Illustrated here is one preferred embodiment of the accretion removing apparatus provided in accordance with the invention.

Figure 1:
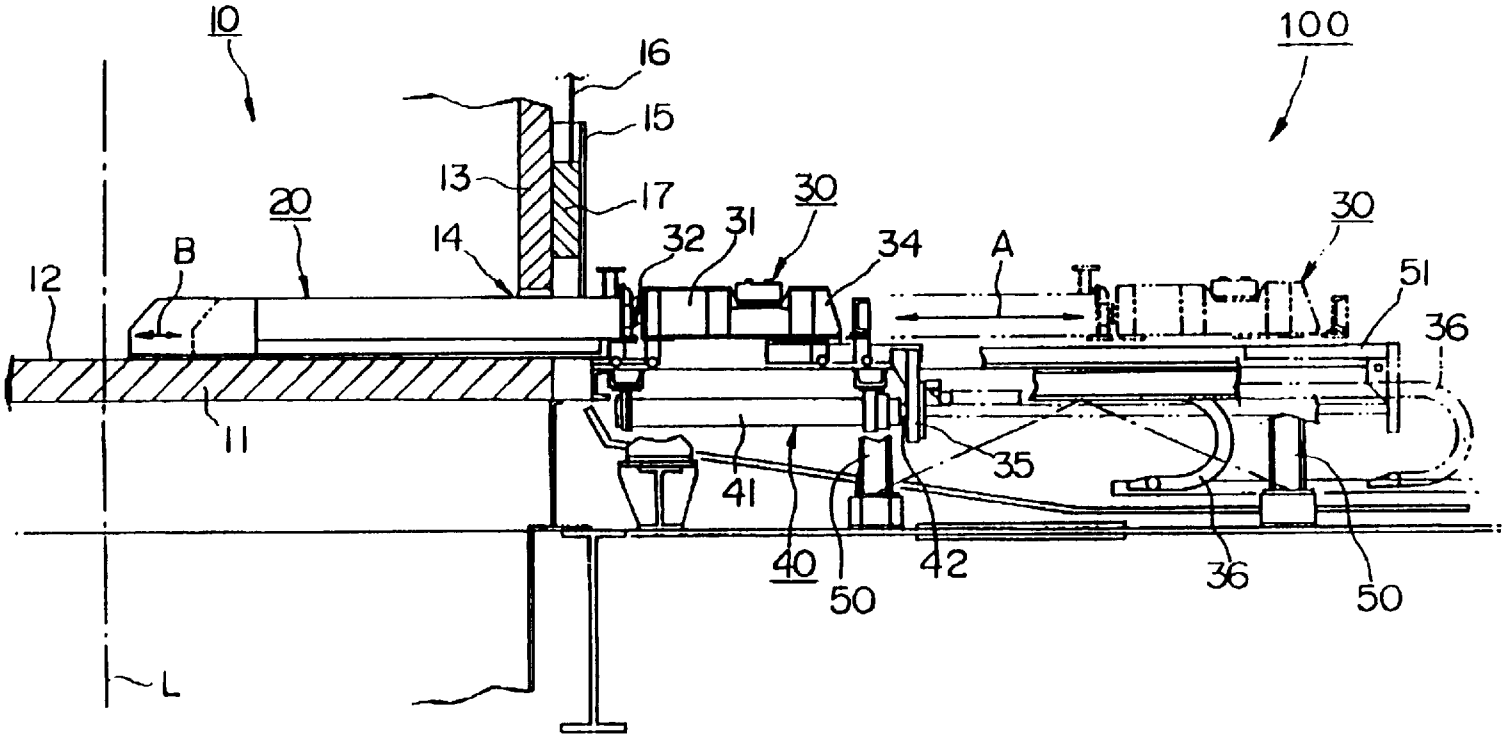
FIG. 1 shows, in side elevation, one preferred embodiment of the accretion removing apparatus according to the present invention.

As shown in FIG. 1, the apparatus 100 according to the invention for removal of an accretion from an uptake in a smelting furnace includes a scraper 20 mounted to slidably move on a horizontal wall surface 12 of an uptake 10, thereby scraping an accretion off the wall surface 12. A first driver 30 is arranged to reciprocate in an axial direction and is connected to the scraper 20 via a joint 200, thereby causing the scraper 20 to slidably reciprocate on the wall surface 12, and second driver 40 reciprocates both the scraper 20 and the first driver 30 between a first position in which the scraper 20 intrudes into the uptake 10 through the opening 14 defined on a side wall of the uptake 10 and a second position in which the scraper 20 is retracted to lie outside the uptake 10.

In this embodiment, the apparatus 100 is disposed in pairs and in symmetrical formation about the widthwise center line L of the uptake 10 as seen in FIG. 1, but only that on the right-hand side in FIG. 1 will be described.

Figure 2:
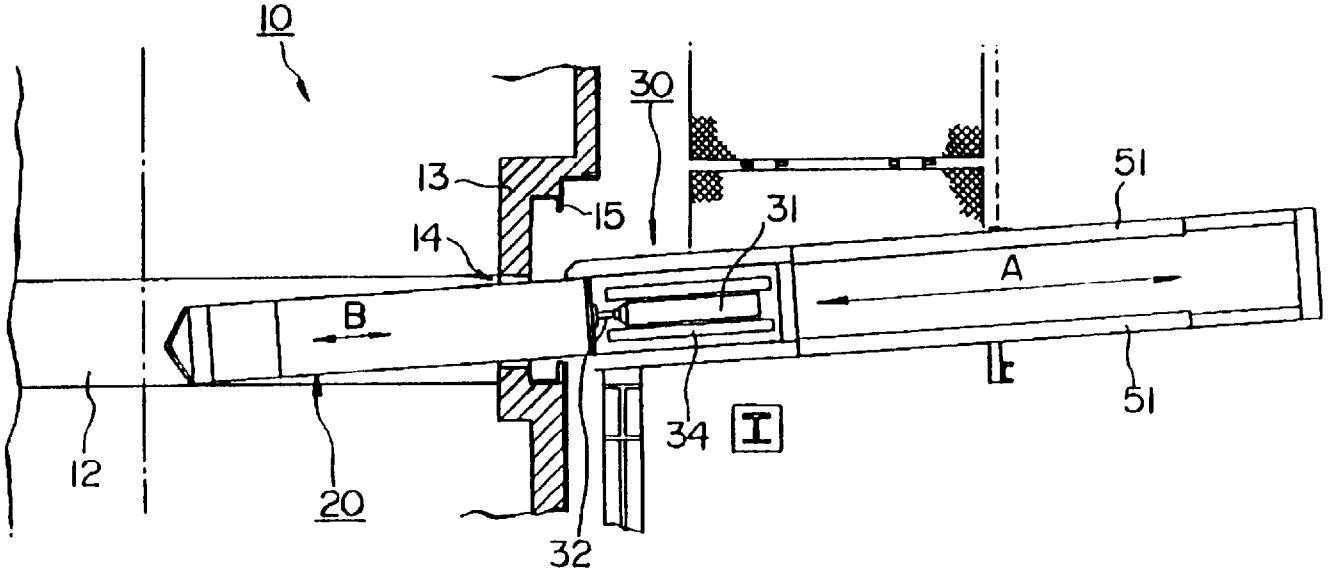
FIG. 2 illustrates, in plan, important parts of the apparatus shown in FIG. 1.
Figure 7:
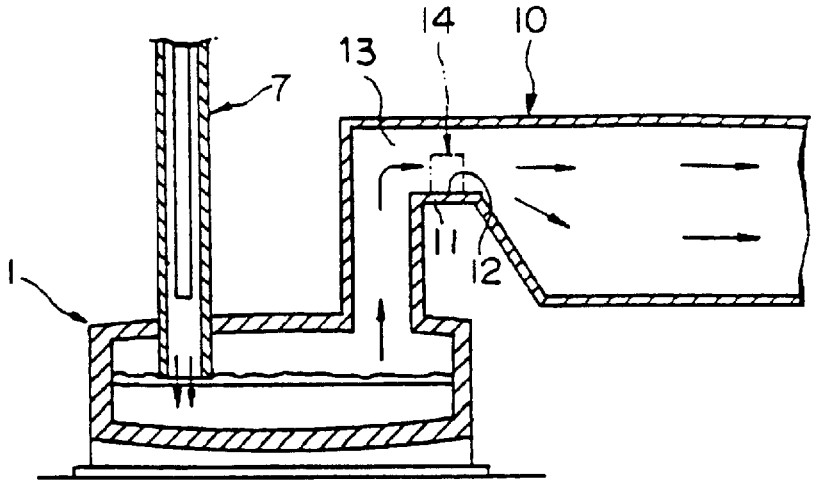
FIG. 7 illustrates, in cross section, a copper smelting apparatus and the corresponding uptake.

The uptake 10, when seen in side elevation and in cross section, has a configuration illustrated in FIG. 7. The apparatus 100 is designed to remove an accretion from the wall surface 12 of the horizontal wall 11. As best seen in FIGS. 1, 2 and 7, a vertical wall 13 of the uptake 10 has a rectangle-shaped through-opening 14 defined for the scraper 20 to move forwardly into and rearwardly out of the uptake 10. A door 17 is guided for vertical movement on the outer surface of the vertical wall 13 by a guide member 15. A wire cable 16 can be used to raise the door 17 to uncover the opening 14.

Figure 3:
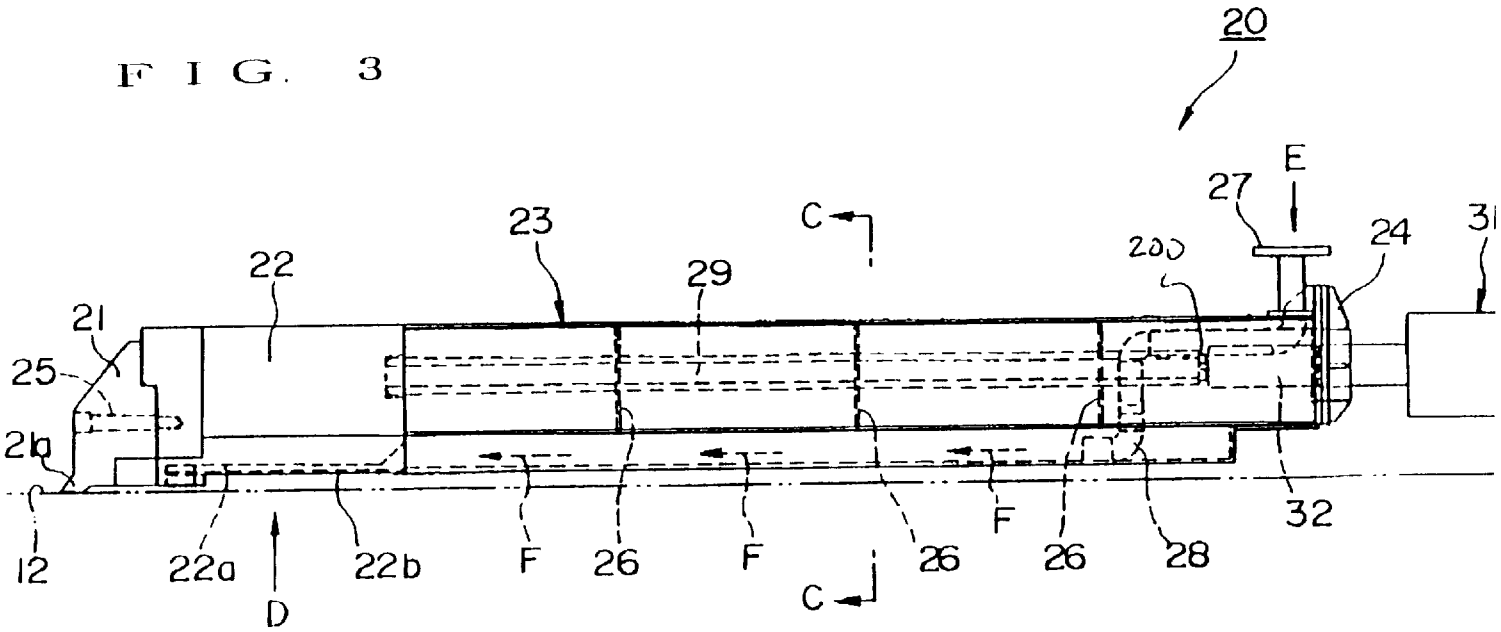
FIG. 3 illustrates, in side elevation and in partial enlargement, a scraper mounted on the apparatus of FIG. 1.

The scraper 20 is constructed, as shown enlarged in FIG. 3, with a pawl body 21 having a sharply tipped pawl member 21 a disposed for intimate contact with the horizontal wall surface 12 to thereby remove an accretion deposited thereon, a block 22 generally of a rectangular parallelopiped shape bolted to the pawl body 21 and spaced from the horizontal wall surface 12 so that the pawl body 21 is pressed against the wall surface 12 by gravity, and a casing 23 connected to the block 22 and extending in an axial direction.

Figure 4:
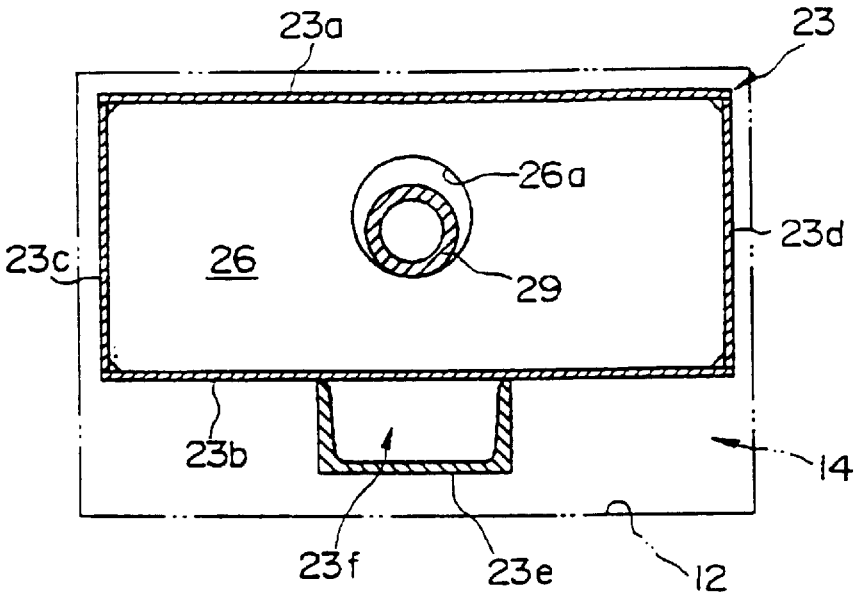
FIG. 4 illustrates, in cross section, the scraper shown in FIG. 3, but taken along the line C—C.

As shown in cross-section in FIG. 4, the casing 23 is rectangular in section and is formed of upper and lower steel strips 23*a* and 23*b*, and right and left steel strips 23*c* and 23*d*. The casing 23 is secured at one of its two ends to the block 22 and is provided at the other end with a flange 24 having an opening through which a piston 32 of the first driver 30 penetrates. A plurality of reinforcing partition panels 26 (three, in the illustrated embodiment) extend in the casing 23 perpendicular to an axial direction thereof The partition panels 26 have circular holes 26*a* in aligned relation to one another for passage of a piping 29.

One of the two ends of the piping 29 is fixed to the block 22, whereas the other end is arranged for abutment of the piston rod 32 of the first driver 30. Thus, the impact force of the piston 32 is transmitted via the piston 29 to the block 22.

Figure 8:
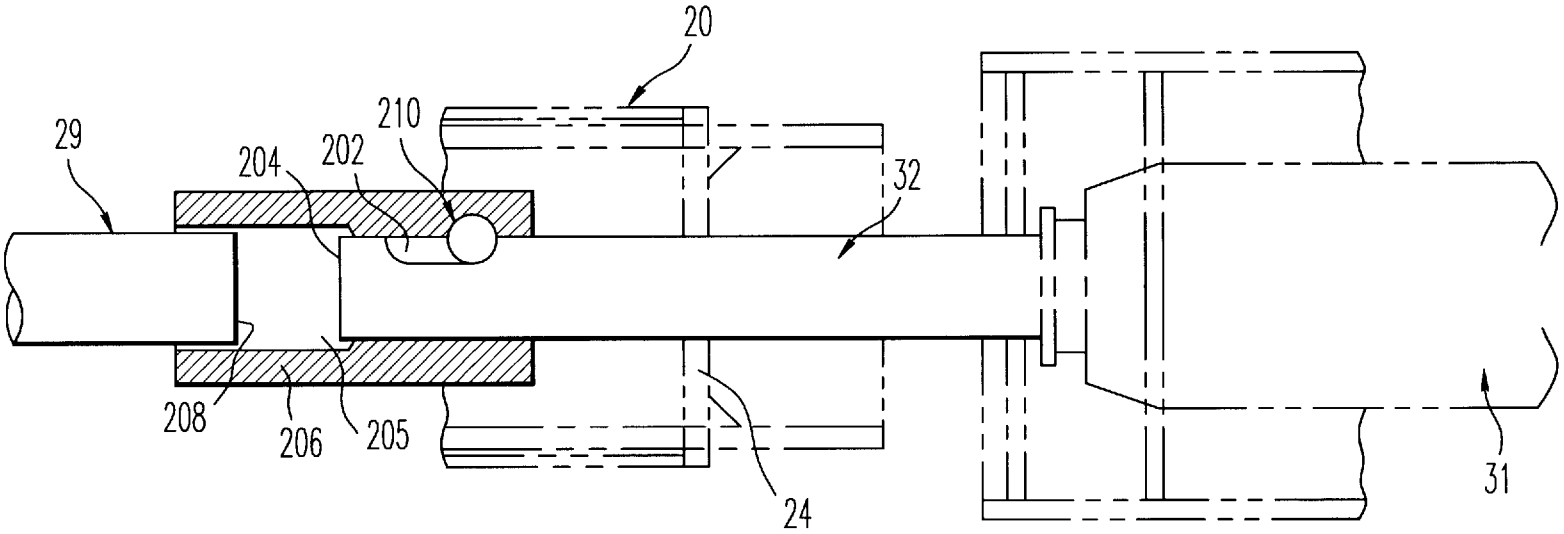
FIG. 8 is a detail of the joint between the scraper and the first driver.

The joint 200 is constructed as shown in FIG. 8. An axial slot 202 is formed in the piston rod 32 near its distal end 204. The distal end and axial slot fit into the bore 205 of a collar-like joint member 206 positioned within the casing 23, and the proximal end 208 of the piping 29 can also fit into the bore 205 of the joint member 206. A pin 210 mounted to the joint member 206 and extending into the bore 205 cooperates with the slot 202 to limit the relative movement or play of the joint member 206 relative to the piston rod to the length of the slot 202. The outer periphery of the joint member 206 is too large to fit through the opening of the flange 24 through which the piston rod 32 extends.

Upon forward movement of the piston rod 32, the joint member 206 is caused to advance with the piston rod once the play at the slot 202 is taken up. The distal end 204 of the piston rod then impacts upon the proximal end 208 of the piping, and the impact force is transferred by the piping to the scraper 20 to advance the scraper. The resulting shock is transmitted via the piping 29 and the block 22 to the pawl body 21, thereby scraping any accretion on the horizontal wall surface 12 by the pawl body 21. Upon rearward movement of the piston rod 32 by a sufficient distance, the joint member 206 abuts the flange 24, and further retraction of the piston rod 32 retracts the scraper 20. The scraper 20 can thus be reciprocally moved by movement of the piston rod.

The outer periphery of the casing 23 is almost as large as the opening 14, and so closes the opening 14, except for a small gap. The gap is sized so as to substantially eliminate the leakage of exhaust gas from between the scraper 20 and the marginal edge of the opening 14, and may be contrasted with the gap which exists in the case where the pawl body 21 and the first driver 30 are connected to each other by, for example, an elongate rod. By maintaining the small gap, the size of the opening 14 may be enlarged without further leakage of the exhaust gas. Thus the scraper 20 may be enlarged for more efficient removal of accretion from the horizontal wall surface 12.

The casing 23 has a U-shaped steel member 23*e* secured fixedly to a lower surface thereof. The member 23*e* cooperates with the casing 23 to define a closed axially extending space 23*f*. As seen in FIG. 3, one end of an S-shaped pipe 28 extends into the closed space 23*f* from the casing 23, while the other end of the pipe 28 has a flange member 27 for connection to a pressurized air-supplying source (not shown). Hence, the closed space 23*f* can receive pressurized air from the supply source.

The pawl body 21 is detachably attached to the block 22 by a bolt 25, as illustrated in FIG. 3. When the pawl member 21 a becomes worn after repeated use, the associated pawl body 21 can be easily replaced with a new one.

The block 22 is substantially a rectangular parallelopiped and is coextensive at its upper plane, and at its right and left sides, with the outer surface of the casing 23.

Figure 5:
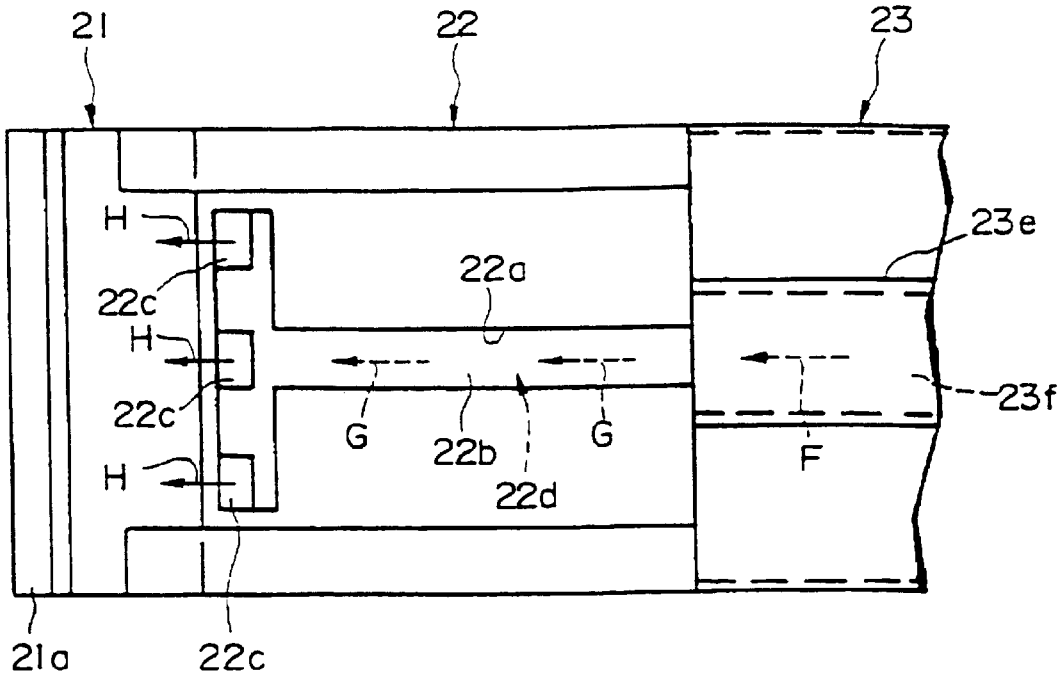
FIG. 5 illustrates, in perspective, a bottom portion of the scraper shown in FIG. 3, seen along the arrow D.
Figure 6:
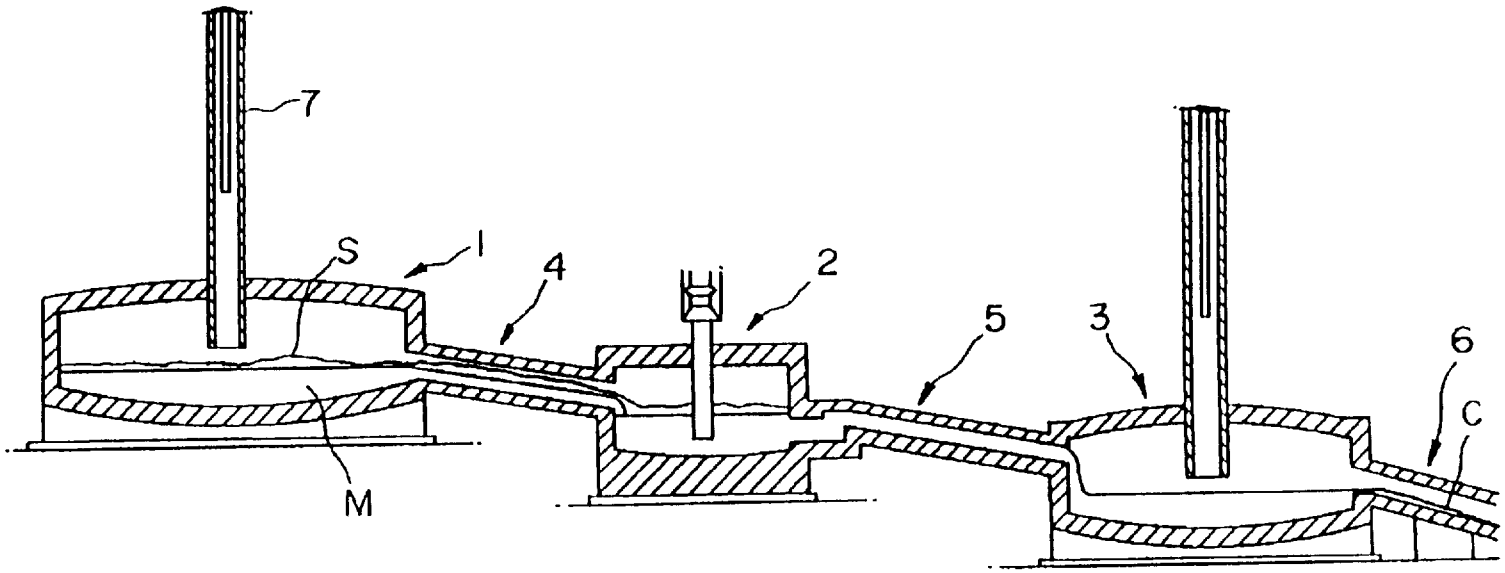
FIG. 6 schematically illustrates, in side elevation and in cross section, an apparatus for continuous production of copper.

As illustrated in FIG. 5, the block 22 has on its lower surface a groove 22*a* of a generally T-shape. A thick planar plate 22*b* is pressed into the groove 22*a* from the open end thereof to form a closed space 22*d* of a T-like shape. The plate 22*b* has three openings 22*c* for the closed space 22*d*. At its end opposed to the recesses 22*c*, the closed space 22*d* communicates with the closed space 23*f* defined beneath the casing 23.

With such a construction, pressurized air from the S-shaped pipe 28 can flow into the T-shaped closed space 22*d* in the direction of the arrow G and can exit from the openings 22*c* in a direction of the arrow H. As a result, any accretion scraped off by the pawl member 21*a* from the horizontal wall surface 12 will be blown off by a flow of pressurized air from the recesses 22*c* toward the pawl member 21*a*. The wall surface 12 is thus cleaned and the accretion removed with utmost ease.

The first driver 30 is comprised of a hydraulic cylinder 31 having the piston rod 32, a truck 34 mounting the hydraulic cylinder 31, a downwardly extending frame 35 coupled integrally with the truck 34, and a hydraulic conduit 36 of a U-shape connected at its one end to the frame 35 so as to supply pressurized oil to the hydraulic cylinder 31.

Upon receipt of pressure oil via the hydraulic conduit 36, the hydraulic cylinder 31 causes the piston rod 32 to rapidly move by a given stroke by the action of a valve (not shown). The piston 32 strikes the end 208 of the piping 29 located in the casing 23, as discussed above, thus imparting a shock or impact to the pawl body 21 in a direction of the arrow B. Hence, the pawl body 21 moves to scrape off any accretion adhered to the horizontal wall surface 12 of the uptake 10.

The truck 34 is itself reciprocably movable in a direction of the arrow A shown in FIG. 1. To this end, the truck 34 is guided by a pair of guide rails 51 supported on a frame member 50 and extending in horizontally parallel relation to each other.

The second driver 40 is constituted, in the embodiment illustrated herein, by a hydraulic cylinder 41. As seen in FIG. 1, the hydraulic cylinder 41 is horizontally supported beneath one of the guide rails 51 and has a piston 42 connected to the frame 35. Movement of the piston 42 thus moves the truck 34, with the result that the scraper 20 is axially reciprocated together with the first driver 30 into and out of the uptake 10. Additionally, the position of the scraper 20 on the horizontal wall surface 12 can be determined as desired.

The following description is directed to the operation of the accretion removing apparatus 100 illustrated in this embodiment.

To begin removal of any accretion having adhered to the horizontal wall surface 12 of the uptake 10, the opening 14 is first opened by raising the normally closed door 17. The piston 42 is then contracted so that both the scraper 20 and the first driver 30 are displaced leftward in FIG. 1. The scraper 20 is thus inserted into the uptake 10 through the opening 14.

In this way, the pawl body 21 of the scraper 20 can be positioned centrally in a widthwise direction of the horizontal wall surface 12 with both the scraper 20 and the first driver 30 being displaced to a maximum extent. Conversely, the pawl body 21 can be positioned on the horizontal wall surface 12 near of the opening 14 with both the scraper 20 and the first driver 30 being displaced to a minimum extent. The entire wall surface 12 can thus be cleaned by impacting the piston 32 on the piping 29 with the pawl body moved to various positions by the cylinder 41.

Exhaust gas flowing in the uptake 10 will not leak outwardly through the opening 14, except for a minimal amount. This is because the spacing between the casing 23 and the peripherally marginal portion of the opening 14 remains small irrespective of the positioning of the pawl body 21 in the uptake 10.

Also, the first driver 30 can be protected from becoming adversely affected by the heat of the exhaust gas flowing in the uptake 10 since it may be retracted to lie outside the uptake.

After positioning the pawl body 21, pressurized air is caused to flow through the S-shaped pipe 28 and the closed spaces 23*f* and 22*d*, as indicated by the arrows F and G in FIG. 5. Hence, the pressurized air blows out toward the pawl body 21 from the recesses 22*c*. The scraped accretion is blown out by the pressurized air toward the pawl body 21. The horizontal wall surface 12 is therefore quickly rendered free of accretion.

Accretion removal is repeated with the pawl body 21 selectively positioned on the horizontal wall surface 12. Any accretion can be fully removed from such wall surface.

After completion of the accretion removing operation, the piston 42 is moved rightward to its fullest extent. Thus, the scraper 20 is placed outside of the uptake 10 and the opening 14 is covered by the door 17.

The accretion removing apparatus illustrated herein is highly capable of mechanical removal of any accretion that has been deposited on the horizontal wall surface 12 of the uptake 10. According to this embodiment, the first driver 30 is so constructed that by use of the hydraulic cylinder 31, a shock is imparted to the pawl body 21 of the scraper 20. Hence, any accretion adherent to the horizontal wall surface 12 is removed with high efficiency.

In addition, the pawl body 21 of the scraper 20 is urged by the weight of the block 22 into press contact with the wall surface 12, with the consequence that such pawl body can sufficiently bite into the accretion on the latter. This contributes greatly to improved efficiency of accretion removal as well as simplified urging of the pawl body 21.

Although the present invention has been described and shown by way of one embodiment wherein a pair of accretion removing apparatuses is used, it is to be noted that the apparatus may be increased in number, or may be turnably disposed about a vertical axis in the case where the horizontal wall surface 12 is large in area.

With the aforementioned construction, manual accretion removal is unnecessary. In addition, accretion removal can be conducted without shutting down the smelting furnace, so that operating efficiency is enhanced.

We claim:

1. An apparatus for removing an accretion from a horizontally extending wall surface of an uptake at the exit of a metal producing furnace, said apparatus comprising:

a scraper disposed to be slidably movable on the wall surface to thereby scrape the accretion off the latter;

a first impact driver arranged to cause said scraper to slidably move on said wall surface; and a second driver arranged to move said scraper and said first driver between a first position in which said scraper is intruded into the uptake from an opening defined on a side wall of the uptake and a second position in which said scraper is retracted to lie outwardly of the uptake.

2. The apparatus according to claim 1, wherein said scraper has an outer surface disposed to be in opposed relation to a peripheral marginal portion of said opening and with a small gap left therebetween when said scraper is in said second position.

3. The apparatus according to claim 1, wherein said scraper includes with means for blowing pressurized air toward said wall surface.

4. The apparatus according to claim 1, wherein said scraper includes a detachable pawl member for scraping the accretion off said wall surface.

* * * * *